United States Patent [19]

Marzocchi

[11] 4,224,373

[45] Sep. 23, 1980

[54] FIBROUS PRODUCT OF NON-WOVEN GLASS FIBERS AND METHOD AND APPARATUS FOR PRODUCING SAME

[75] Inventor: Alfred Marzocchi, Newark, Ohio

[73] Assignee: Owens-Corning Fiberglas Corporation, Toledo, Ohio

[21] Appl. No.: 972,746

[22] Filed: Dec. 26, 1978

[51] Int. Cl.[2] ..... D04H 1/58

[52] U.S. Cl. ..... 428/288; 65/3 C; 65/3 R; 65/4 R; 65/6; 65/14; 428/297

[58] Field of Search ..... 428/288, 297, 298, 299, 428/296, 903; 65/3 R, 3 C, 4 R, 6, 14

[56] References Cited

U.S. PATENT DOCUMENTS

| | | | |
|---|---|---|---|
| 2,399,260 | 4/1946 | Taylor | 428/903 |
| 2,731,066 | 1/1956 | Hogendobler et al. | 428/294 |
| 2,778,763 | 1/1957 | Novak | 428/903 |
| 3,012,281 | 12/1961 | Stalego | 65/6 |
| 3,016,599 | 1/1962 | Perry | 428/903 |
| 3,219,425 | 11/1965 | Stalego | 65/6 |
| 4,147,574 | 4/1979 | Setsure | 428/903 |

*Primary Examiner*—James J. Bell

*Attorney, Agent, or Firm*—Ronald C. Hudgens; Greg Dziegielewski; Harry O. Ernsberger

[57] ABSTRACT

The disclosure embraces a fibrous product in which fibers of an assemblage of fibers are bonded together by fine discrete binder fibers and to a method and apparatus for producing same wherein fine discrete highly-flexible binder fibers are entrained in or influenced by streams of gas such as air streams to be intermingled with the fibers of the assemblage, the velocities of the streams of gas or air being sufficient to cause the discrete binder fibers to be wrapped around fibers of the assemblage for bonding the assemblage of fibers into an integrated or unitary fibrous product such as a nonwoven textile, fibrous mat or body.

30 Claims, 15 Drawing Figures

FIBROUS PRODUCT OF NON-WOVEN GLASS FIBERS AND METHOD AND APPARATUS FOR PRODUCING SAME

This invention relates to the production of nonwoven fibrous textiles and nonwoven fibrous mats or bodies wherein fine highly-flexible discrete fibers are distributed into or dispersed throughout an assemblage or group of glass fibers under conditions whereby the flexible discrete fibers are wrapped around fibers of the assemblage for bonding the fibers of the assemblage into a nonwoven fibrous product.

In the methods heretofore used in producing nonwoven textiles, mats or bodies of fibers, it has been conventional practice to bond the fibers of an assemblage together and particularly fibers of glass or other mineral materials by utilizing conventional bonding resins or adhesives and curing the bonding material to hold the fibers together.

Such prior processes necessitate the utilization of binder curing facilities for setting or curing the resinous binder or adhesive in nonwoven textiles, fibrous mats or bodies. Resin binders or adhesives of the character suitable for bonding fibers and particularly glass fibers together are costly and considerable time is required for setting or curing the binder in the product which factors necessarily increase the cost of production of nonwoven textiles or nonwoven mats or bodies of glass fibers.

The invention has for an object the provision of a method for use in producing or forming nonwoven textiles, mats or bodies of fibers and more particularly glass fibers wherein the fine discrete highly-flexible fibers are distributed or dispersed by currents of air or air streams throughout the fibers of an assemblage of fibers, the fine fibers being wrapped around the fibers of the assemblage by the air streams or air turbulence set up by the air streams, the fine discrete fibers forming the bonding media holding the fibers together as an integrated stable fibrous product.

An object of the invention embraces a method wherein fine discrete highly-flexible fibers are entrained in or influenced by air jets or air streams and dispersed or distributed thereby throughout a nonwoven assemblage of fibers, the fibers of the fiber assemblage being of larger diameters than the diameters of the discrete binder fibers and the fine discrete fibers caused by the moving air to be wrapped around the larger diameter fibers, the fine discrete fibers functioning to bind or hold the fibers of larger diameters together as an integrated or bonded fibrous product.

Another object of the invention resides in a fibrous product comprising a nonwoven assemblage of fibers such as glass fibers and fine discrete binder fibers dispersed throughout the assemblage, the discrete fibers being wrapped around the fibers of the assemblage to form an integrated stable nonwoven textile or nonwoven mat or body of fibers.

Another object of the invention residues in the provision of a method of distributing or dispersing fine discrete highly-flexible fibers by air jets or air streams into a nonwoven mass or assemblage of fibers or into opened strands of fibers, the fine discrete fibers wrapping around the fibers for effectively bonding or holding the fibers together as an integrated stable fibrous product.

Another object of the invention residues in a method of and apparatus for forming a nonwoven textile or nonwoven mat or body of fibers from a nonwoven assemblage of fibers such as glass fibers or fibers of other materials involving distributing or dispersing throughout the assemblage fine discrete highly-flexible fibers of organic or inorganic material by air streams wherein turbulence is effective to wrap the fine discrete fibers around the fibers of the assemblage whereby the fine discrete fibers provide the bonding media for stabilizing and maintaining the assemblage of fibers as a nonwoven fibrous product. Further objects and advantages are within the scope of this invention such as relate to the arrangement, method of operation and function of the related elements, to various details of construction and to combinations of parts, elements per se, and to economies of manufacture and numerous other features as will be apparent from a consideration of the specification and drawing of a form of the invention, which may be preferred, in which:

FIG. 1 is a schematic elevational view of a fiber-forming instrumentality of a character for forming attenuated glass fibers in association with means for distributing or dispersing fine discrete binder fibers throughout the attenuated fibers by air streams in the formation of a nonwoven bonded fibrous product;

FIG. 1*a* is a schematic view taken substantially on the line 1*a*—1*a* of FIG. 1;

Figure 5:
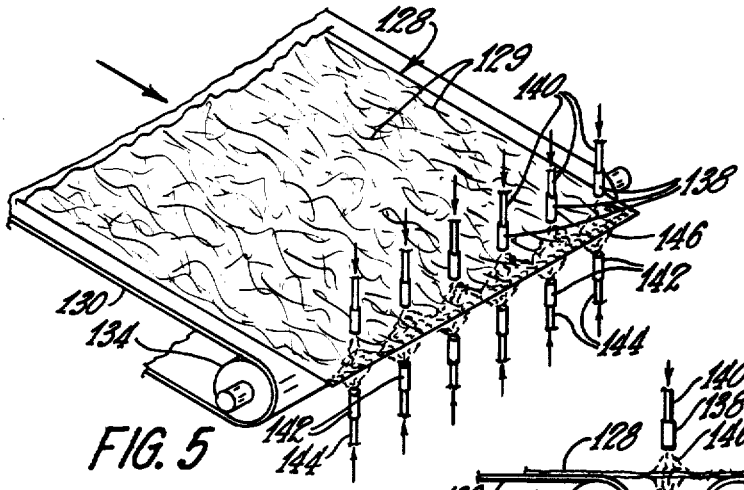
FIG. 5 is a fragmentary isometric view of a nonwoven textile-like mat or body of glass fibers on a moving conveyor means in association with air jet means for delivering entrained fine discrete binder fibers into the nonwoven textile, mat or body of fibers while supported by the conveyor means.
Figure 6:
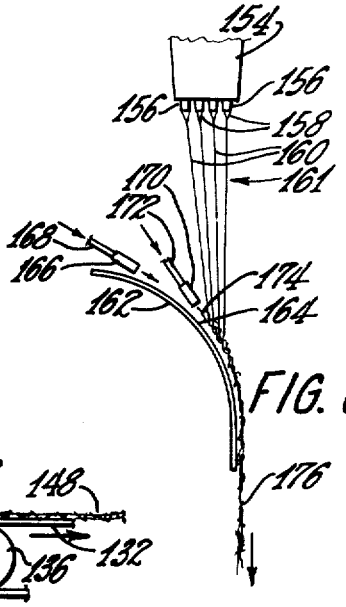
Figure 5A:
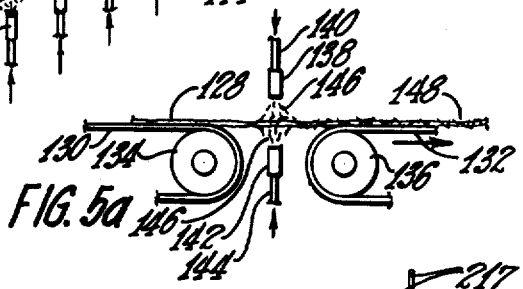
Figure 7:
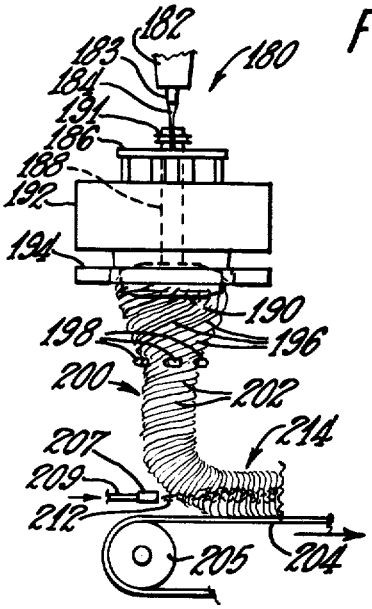
Figure 7A:
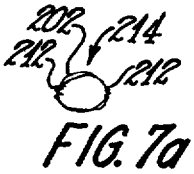
Figure 8:
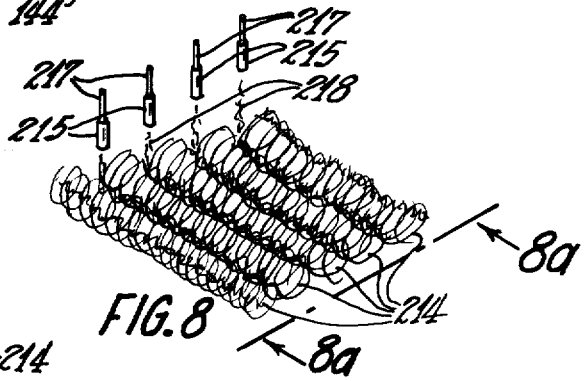
Figure 8A:
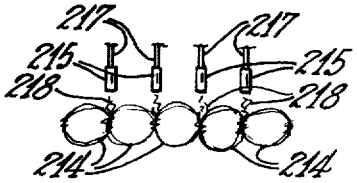
Figure 9:
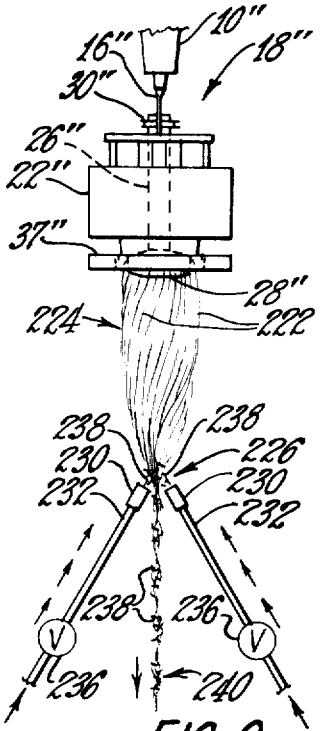
Figure 10:
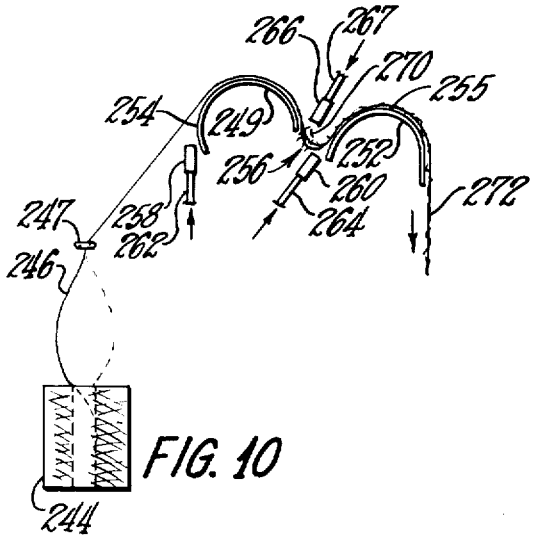
Figure 11:
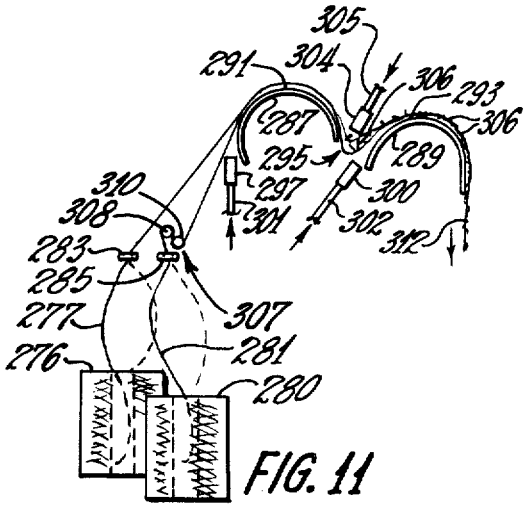

FIG. 5*a* is a side elevational view of the conveyor means of FIG. 5 illustrating an arrangement of air jet means for distributing and dispersing fine discrete binder fibers into the textile, mat or body of attenuated glass fibers from regions above and below the textile, mat or body;

FIG. 6 is a schematic elevational view of an arrangement illustrating a method for distributing or dispersing fine discrete binder fibers under the influence of air streams into an assemblage or group of attenuated continuous filaments or fibers of glass;

FIG. 7 is a schematic elevational view of a centrifugal instrumentality for forming attenuated glass fibers in association with means for influencing the fibers to move in a spiral path and means for delivering or dispersing air jet entrained fine discrete binder fibers into the spiral configuration of attenuated glass fibers;

FIG. 7*a* is an end view of the spiral orientation of the attenuated glass fibers shown in FIG. 7 illustrating the fine discrete binder fibers wrapped about the spirally-oriented attenuated glass fibers;

FIG. 8 is a schematic isometric view of a fibrous product comprising a plurality of spirally-arranged bodies of attenuated glass fibers illustrating the method of bonding the bodies of fibers together by fine discrete binder fibers;

FIG. 8*a* is a view taken substantially on the line 8*a*—8*a* of FIG. 8;

FIG. 9 is a schematic elevational view of a fiber-forming instrumentality wherein the attenuated glass fibers are converged into a linear body or tow in association with means for intermittently directing fine discrete fibers under the influence of intermittent air streams into the region of convergence of the glass fibers for binding the fibers into a linear body or tow;

FIG. 10 is a schematic view of an arrangement for carrying out the method of opening up strands of fibers by air jets or air streams and directing fine discrete binder fibers into the opened regions of the strands for commingling the fine discrete fibers with the fibers of the opened strands, and FIG. 11 is a schematic view of an arrangement for carrying out the method involving retarding the speed of advancement of one or more of several advancing strands to effect an opening up of the fibers of the strands to receive discrete binder fibers. The method of the invention involves processing a nonwoven assemblage of fibers, such as glass fibers, and delivering into the nonwoven fibrous assemblage fine discrete highly-flexible fibers under the influence of air streams or air jets into intermingling engagement with the fibers of the assemblage wherein the fine discrete fibers, under the influence of the air streams, are wrapped around the fibers of the assemblage to bond the fibers into a product such as a nonwoven textile, mat, body of fibers or a tow.

The fibers of the assemblage are of larger diameters than the fine discrete binder fibers and the coarser fibers are stiffer or less flexible than the discrete binder fibers, the latter being highly flexible or limp so as to effectively wrap around the coarser fibers to bind the fibers into a nonwoven textile, mat or body providing a stable product by reason of the bonding characteristics of the highly-flexible fibers wrapped around the coarser fibers.

While the method of the invention is particularly applicable for bonding glass fibers of nonwoven textile products, mats or bodies together by fine discrete binder fibers, it is to be understood that the invention embraces the utilization of fine discrete fibers as a bonding media with other fibers in forming nonwoven textile products, mats or bodies. It has been found preferable to utilize very fine discrete highly-flexible glass fibers as binder fibers for holding the fibers of an assemblage in a stable condition but it is to be understood that the fine binder fibers may be of other inorganic material or may be of organic materials such as resin fibers.

Figure 1:
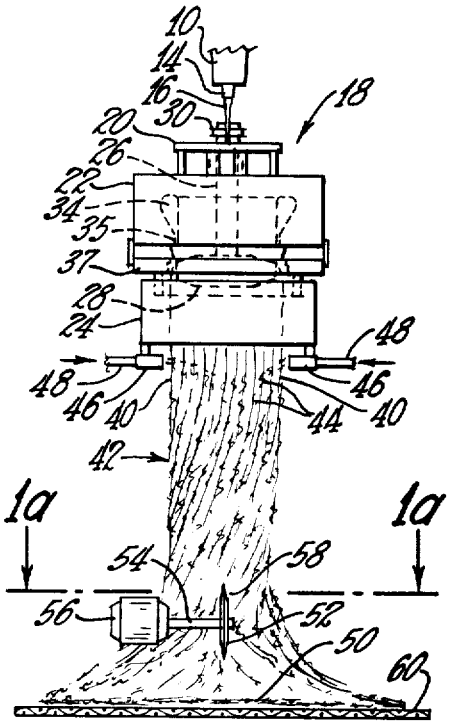

The glass fibers of the assemblage utilized in producing a bonded nonwoven textile, mat or body may be formed by various methods and the fine discrete binder fibers delivered into intermingling and wrapping relation with the fibers of the assemblage to bond the fibers of the assemblage into a unitary fibrous product. FIG. 1 is a schematic illustration of one form of instrumentality or apparatus for forming attenuated glass fibers making up the assemblage for a nonwoven textile, mat or body in association with an arrangement for delivering or projecting the discrete binder fibers into wrapping relation with the fibers of the assemblage or body.

Referring to FIG. 1, a stream feeder 10 depends from a conventional forehearth (not shown), the forehearth receiving molten glass from a glass melting and refining furnace. The stream feeder 10 is provided with a depending orificed projection 14 from which flows a stream 16 of molten glass. Disposed beneath the stream feeder 10 is a fiber-forming unit or instrumentality 18. The fiber-forming instrumentality 18 is inclusive of a supplemental frame 20 which is supported by a main frame (not shown) of conventional construction.

Secured to the frame 20 is a circular member 22. Disposed beneath the member 22 is a cylindrically-shaped metal guard 24 which surrounds the fiber-forming region. Journally mounted in bearings carried by the frame member 20 is a hollow or tubular shaft 26 to the lower end of which is secured a rotatable hollow spinner or rotor 28, the upper end of the shaft being provided with a sheave or pulley 30 which is driven by an electrically energizable motor (not shown) through the medium of a driving belt (not shown) in a conventional manner.

The stream 16 of glass flows through the hollow shaft 26 into the hollow spinner 28. The peripheral wall of the spinner 28 is fashioned with a large number of small orifices or passages (not shown), there usually being ten thousand or more orifices through which the heat-softened glass in the interior of the spinner is projected outwardly by centrifugal forces as fine streams of glass.

The member 22 encloses and supports a refractory-lined annular combustion chamber 34 having an annular discharge outlet or throat 35 adjacent and above the peripheral wall of the spinner 28. A gaseous fuel and air mixture is admitted into the chamber 34 and combustion occurs therein, the products of combustion being extruded through the annular outlet 35 as a high temperature gas stream providing a heated environment surrounding the peripheral wall of the spinner 28.

Surrounding the spinner 28 is an annular blower 37 of conventional construction having an annular outlet or delivery orifice adjacent to and spaced from the peripheral wall of the spinner 28. Steam, compressed air or other gas under pressure is supplied to the blower 37 and the gaseous blast from the blower outlet engages the streams of glass centrifuged from the orifices in the wall of the spinner, the forces of the blast attenuating the centrifuged streams of glass into fibers 40. The fibers 40 move downwardly away from the spinner as an assemblage or body 42 of fibers in the form of a hollow generally cylindrical veil.

A feature of the invention resides in bonding the fibers constituting the assemblage together through the delivery into the fiber assemblage of fine discrete highly-flexible binder fibers 44 under conditions causing the fine discrete binder fibers to wrap around fibers of the assemblage of attenuated fibers and form a nonwoven textile, mat or group as a bonded fibrous product, the binder fibers providing the media holding or maintaining the fibers of the assemblage in a stable or bonded condition.

Disposed beneath the fiber attenuating facility 18 and preferably supported by the member 24 are nozzles 46, two of the nozzles being illustrated in FIG. 1. It is to be understood that more than two nozzles are employed and are spaced apart circumferentially of the veil 42 of fibers and directed generally radially toward the veil. The nozzles 46 are connected by tubes 48 with a source of compressed air or other gas under pressure and with a supply (not shown) of fine discrete binder fibers.

The fine discrete binder fibers 44 may be introduced into the air streams in the tubes 48 by aspiration from a supply of fine discrete fibers or by other conventional methods into the air flowing in the tubes 48, the binder fibers being entrained in the moving air. The air streams with the entrained binder fibers are projected from the nozzles 46 into engagement with the fibers 40 of the assemblage 42 and the binder fibers, under the influence of the air streams and air turbulence set up by the air streams from the nozzles 46, are intermingled with and wrapped around the fibers 40 of the assemblage and thereby bind the fibers 40 of the assemblage into a stable integrated fibrous body.

Figure 1A:
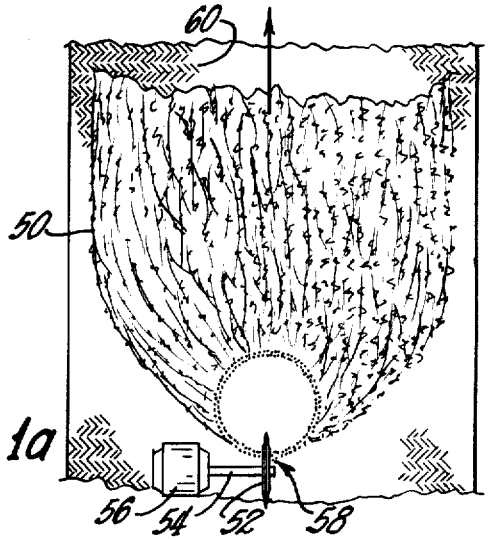

The assemblage 42 of fibers bonded together by the fine discrete fibers 44 may be processed to form a sheet-like bonded nonwoven textile or fibrous mat 50. The hollow cylindrical bonded assemblage 42 of glass fibers and discrete binder fibers may be severed at one region to provide the sheet-like nonwoven textile or body 50 of planar configuration. As shown in FIGS. 1 and 1*a*, a rotary severing instrumentality 52 is mounted on a shaft 54 driven by an electrically energizable motor 56.

Figure 2:
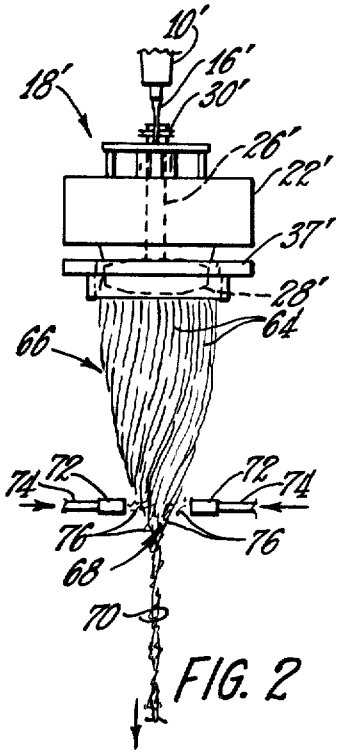
FIG. 2 is a schematic elevational view of a fiber-forming instrumentality for forming attenuated glass fibers in association with means for dispersing or distributing fine discrete binder fibers throughout the attenuated glass fibers wherein the fibrous mixture is formed into a fiber-bonded linear product or tow.

The cutting instrumentality 52 severs the hollow veil or assemblage of bonded fibers at a region 58, the severed body being deposited or collected on a conventional endless-type conveyor 60, the fiber-bonded assemblage being spread on the conveyor as illustrated in FIGS. 1 and 2 as a fiber-bonded nonwoven textile or mat of sheet-like or planar formation.

Where the fibers 40 of the assemblage 42 are attenuated glass fibers, they may be of diameters preferably in a range of twenty hundred thousandths and seventy hundred thousandths or more of an inch. The binder fibers 44 may be glass fibers and are of lesser diameters than the diameters of the fibers of the assemblage, the highly-flexible fine discrete fibers being preferably in a range of ten hundred thousandths and eighteen hundred thousandths of an inch. The fine discrete binder fibers are preferably of a length in a range of one sixty-fourth of an inch and one half of an inch.

It is to be understood that the concept of the invention embraces the use of highly flexible fine discrete fibers as a bonding media for bonding coarser fibers of the assemblage into a bonded stable product. The foregoing ranges in size of the fibers of the assemblage and the range of size of the binder fibers are exemplary in producing a nonwoven fiber-bonded fibrous product or mat. It is essential in carrying out the method of the invention to utilize discrete binder fibers of lesser diameters than the fibers of the assemblage and that such binder fibers must be more flexible than the coarser fibers of the assemblage to effectively promote a wrapping of the flexible binder fibers around the coarser fibers to result in a satisfactorily bonded fibrous product.

FIG. 2 is illustrative of an arrangement for carrying out the method of the invention in forming an assemblage of fibers, such as glass fibers, into a product such as a linear body or tow in which the fibers of the assemblage are bonded into a tow through the use of fine discrete binder fibers disposed in wrapping relation around the fibers of the assemblage to form a fiber-bonded fibrous tow.

The fiber attenuating instrumentality 18' shown in FIG. 2 is of the character shown in FIG. 1. A stream 16' of molten glass flows from a feeder 10' into a hollow spinner or rotor 28' mounted on a lower end of a hollow shaft 26', the spinner being rotated by a motor (not shown) driving a sheave 30' on th shaft 26'. A heated environment is provided at the periphery of the spinner 28' by products of combustion from a combustion chamber of the character illustrated at 34 in FIG. 1 and enclosed by an annular member 22'.

The peripheral wall of the spinner 28' is provided with a large number of orifices through which streams of molten glass are delivered by centrifugal forces of rotation of the spinner into a gaseous blast of steam or compressed air from a blower 37', the forces of the blast attenuating the centrifuged streams of glass into fibers 64 of a fiber assemblage 66. The fibers of the assemblage 66 are converged at a region 68 to a linear group by means (not shown) advancing the group downwardly away from the fiber-forming instrumentality 18'.

Disposed above the region of convergence 68 is a plurality of nozzles 72 circumferentially spaced around the assemblage 66 of fibers and generally radially directed toward the assemblage, two of the nozzles being illustrated in FIG. 2. Connected with the nozzles 72 are tubes 74 which are connected with a source of compressed air and a supply of fine discrete binder fibers. The binder fibers are entrained in the air moving through the tubes 74, and the air streams and entrained binder fibers 76 are projected from the nozzles 72 into intermingling engagement with the fibers 64 of the assemblage 66.

The fine discrete binder fibers delivered from the nozzles 72 are influenced by the air streams and air turbulence set up by the air streams to be wrapped around fibers 64 of the assemblage, the wrapping action binding the fibers together to form a bonded linear body or tow 70. The fine flexible binder fibers 76 wrapping around the fibers 64 provide a fiber bonded integrated stable fibrous product.

Figure 3:
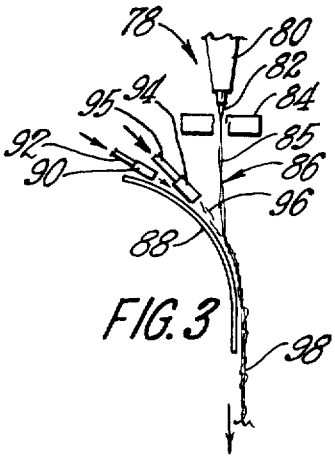
FIG. 3 is a schematic elevational view of a fiber-forming instrumentality wherein glass fibers are formed by blast attenuation of glass streams flowing from a stream feeder in association with means for delivering fine discrete binder fibers by air streams into the attenuated glass fibers moving along a curved surface.

FIG. 3 illustrates a method of applying fine discrete binder fibers to a linear group or assemblage of attenuated glass fibers through the utilization of air streams directed along a guide surface and conveying fine discrete binder fibers by the air streams into intermingling wrapping relation with the attenuated fibers of the linear group or assemblage. The arrangement for carrying out the method is inclusive of a fiber-forming facility 78 comprising a stream feeder 80 from which flows streams 82 of molten glass.

A blower 84 is arranged to deliver blasts of air or other gas downwardly for attenuating the glass streams to fibers 85 forming a linear group or assemblage 86 of blast-attenuated fibers. Beneath the fiber-forming arrangement 78 is a guide means or member 88 of curved configuration mounted in a position whereby the group 86 of fibers is engaged with and moves along the convex upper surface of the guide member 88.

Positioned generally in tangential relation with the upper or convex surface of the guide member 88 is a plurality of nozzles 90 in side-by-side relation, one of the nozzles being shown in FIG. 3. The nozzles 90 are connected by tubes 92 with a supply of compressed air and direct air streams tangentially of the convex surface of the guide member 88. The air streams tend to follow the curvature of the guide member 88 and engage and open up the fibers 85.

Mounted adjacent the air delivery nozzles 90 are nozzles 94 arranged in side-by-side relation, one of the nozzles being illustrated in FIG. 3. The nozzles 94 are connected by tubes 95 with a supply of fine discrete binder fibers, such as glass fibers, the discrete binder fibers 96 being deliverd from the nozzles 94 into the influence of the air streams from the nozzles 90, the air streams and the air turbulence set up by the air streams conveying the fine discrete fibers into intermingling wrapping relation with the fibers 85 at the region of the engagement of the fibers 85 with the convex curved surface of the guide member 88.

The air streams from the nozzles 90 tend to open up the fibers 85 and the air streams from the nozzles 90 cause the fine discrete binder fibers to be wrapped around the fibers 85 of the linear group or assemblage 86 binding the fibers of the linear group or assemblage into a fibrous product 98. The fiber-bonded product 98 may be of sheet-like configuration and of a thickness depending on the number of fibers attenuated from glass streams 82 flowing from the feeder 80. The fiber-bonded fibrous product 98 is in the form of a nonwoven textile or the like and may be collected on a spool or collected by other suitable means.

Figure 4:
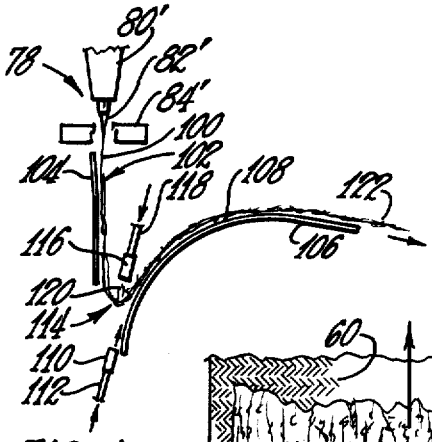
FIG. 4 is a schematic elevational view of a glass fiber-forming instrumentality for forming blast-attenuated glass fibers and altering the direction of travel of the blast-attenuated fibers by moving air streams and distributing or dispersing fine discrete binder fibers throughout the attenuated glass fibers at the region of change of direction of movement of the attenuated glass fibers.

FIG. 4 discloses a modification of the method of bonding an assemblage of attenuated glass fibers by discrete binder fibers to form a nonwoven fibrous product such as a nonwoven textile. A fiber-forming instrumentality 78' is utilized to attenuate glass streams to fibers. A glass stream feeder 80' containing molten glass has one or more rows of depending orificed projections from which flow glass streams 82' which are attenuated to fibers 100 of an assemblage 102 of fibers by steam or air blasts from a blower 84'.

The assemblage 102 of fibers is guided downwardly away from the fiber attenuating instrumentality 78' by a guide member or baffle 104. Disposed at one side of the guide member 104 is a second guide means or member 106 of curved configuration having a convex upper surface 108. Disposed adjacent a lower portion of the curved guide member 106 is a row of nozzles 110 connected by tubes 112 with a supply of compressed air. While one nozzle 110 and tube 112 are illustrated in FIG. 4, it is to be understood that a plurality of nozzles and tubes are arranged in side-by-side relation in one or more rows.

Air streams from the nozzles 110 directed along the upper convex surface 108 of the guide member 106 abruptly change the direction of movement of the assemblage 102 of fibers 100 at a transition region 114 to open up the fibers 100 and convey them along the convex curved surface 108 as illustrated in FIG. 4. Disposed at the region of transition of direction of the assemblage 102 of fibers is a plurality of nozzles 116 in side-by-side relation connected by tubes 118 with a supply (not shown) of fine discrete binder fibers. The binder fibers 120 are delivered by the nozzles 116 into intermingling relation with the fibers 100 of the assemblage 102 at the change of direction at the region 114.

Under the influence of the moving air streams from the nozzles 110 and air turbulence set up by the air streams, the fine discrete binder fibers are wrapped around the opened fibers 100 of the assemblage 102 whereby the fibers 100 of the assemblage are bonded or integrated together forming a nonwoven textile or similar fibrous product 122. The fibrous product 122 may be collected on a spool (not shown) or collected by other means.

FIGS. 5 and 5*a* illustrate a method of applying fine discrete binder fibers into a planar or sheet-like body or assemblage of glass fibers during advancement of the sheet-like body or assemblage to form a fiber-bonded nonwoven textile or similar fibrous product. An assemblage or body 128 of glass fibers 129 is illustrated as being advanced by endless type belt conveyors 130 and 132.

The conveyor 130 is mounted on rolls 134, one of which is shown in FIGS. 5 and 5*a*. The conveyor 132 is mounted on rolls 136, one of which is illustrated in FIG. 5*a*. The illustrated rolls 134 and 136 are arranged in spaced relation as shown in FIG. 5*a*. Disposed transversely of and above the advancing assemblage or body 128 of fibers 129 is a row of nozzles 138 which are connected by tubes 140 with a source of compressed air or other gas and a supply (not shown) of fine discrete binder fibers.

Disposed below and preferably in alignment with the nozzles 138 is a second row of nozzles 142, the nozzles 142 being arranged in the space between adjacent rolls 134 and 136 supporting the moving conveyors 130 and 132. The nozzles 142 are connected by tubes 144 with a source of compressed air or other gas and a supply (not shown) of fine discrete binder fibers.

As the fiber assemblage or body 128 is advanced by the conveyors, fine discrete binder fibers 146 entrained in air streams projected from the nozzles 138 and 142 are delivered into intermingling and wrapping relation with the fibers 129 of the fiber assemblage 128, the binder fibers 146, under the influence of the air streams and air turbulence set up by the air streams projected from the nozzles 138 and 142, being wrapped around the fibers 129 of the fiber assemblage 128 bonding the fibers 129 together forming a bonded stable nonwoven textile or similar product 148.

FIG. 6 discloses a modified method of the invention of delivering fine discrete binder fibers into a group or assemblage of attenuated continuous fibers or filaments for binding the continuous fibers or filaments into an integrated fibrous product, such as a nonwoven textile, mat or body of fiber-bonded continuous fibers or filaments.

The arrangement illustrated in FIG. 6 is inclusive of a stream feeder 154 which contains molten glass supplied from a melting and refining furnace (not shown) or other supply of molten glass, the feeder 154 having a large number of orificed depending projections 156 through which flow streams 158 of molten glass which are attenuated to continuous fibers or filaments 160 as a group or assemblage 161.

The stream feeder 154 is of conventional elongated rectangular shape. Arranged beneath the feeder 154 is a guide means or member 162 preferably of curved configuration, the continuous fibers 160 moving along the convex surface 164 of the member 162. Disposed adjacent an upper region of the guide member 162 is a plurality of nozzles 166 arranged in side-by-side relation, the nozzles 166 being connected by tubes 168 with a supply of compressed air or other gas, only one of the nozzles 166 and a tube 168 being shown in FIG. 6. The velocity of the air streams from the nozzles 166 provides the forces attenuating the glass streams 158 into continuous fibers or filaments 160, the air streams from the nozzles 166 tending to follow the curvature of the surface 164 of the guide member or means 162.

Arranged in a region adjacent the convex surface 164 of member 162 and between the air delivery nozzles 166 and the continuous fibers moving toward the member 162 is a plurality of nozzles 170 in side-by-side relation, one of which is shown in FIG. 6. The nozzles 170 are connected by tubes 172, one of which is shown in FIG. 6, with a supply of fine discrete binder fibers.

The discrete binder fibers 174 are delivered from the nozzles 170 and are conveyed by the air streams from the nozzles 166 into intermingling relation with the advancing continuous fibers or filaments 160 of the assemblage or group 161 and, under the influence of the air streams and air turbulence set up by the air streams, the binder fibers 174 are caused to be wrapped around the continuous fibers 160 to form a nonwoven fibrous textile 176 in which the continuous fibers are bonded together by the binder fibers to form a stable product. The fibrous product 176 may be collected upon a rotating spool (not shown) or the product collected by other conventional means.

FIG. 7 illustrates a method of forming attenuated glass fibers into a hollow spiral or coiled orientation of fibers and bonding the fibers of the spiral or coil configuration together through the media of fine discrete binder fibers. The fiber-forming facility or instrumentality 180 is of the character shown in FIG. 1 and is inclusive of a feeder 182 containing molten glass, the feeder having a depending orificed projection 183 through which flows a stream 184 of molten glass.

The fiber-forming instrumentality 180 includes a frame construction 186 in which is journaled a hollow or tubular shaft 188 equipped at its lower end with a hollow spinner 190 and the upper end of the shaft equipped with a sheave 191 which is driven by an electrically energizable motor (not shown) for rotating the spinner 190. The peripheral wall of the spinner has a large number of openings or orifices through which the glass in the spinner is discharged as fine streams under the influence of centrifugal forces.

A circular member 192 mounted by the support means 186 encloses a combustion chamber in which a mixture of fuel and air is combusted and the products of combustion discharged from the combustion chamber through an annular throat or opening to provide a heated environment along the peripheral wall of the spinner 190. The streams of glass centrifuged from the spinner are engaged by a high velocity air or gaseous blast from a blow 194 for attenuating the centrifuged streams of glass to fibers 196. The fibers 196 move downwardly away from the fiber-forming instrumentality 180 in a generally hollow formation.

Disposed below the spinner 190 and arranged circumferentially of the group of fibers 196 is a plurality of nozzles 198 connected with a supply of compressed air or other gas, the nozzles 198 being arranged to direct streams of air or other gas generally tangentially of the group of fibers 196 whereby the fibers are oriented under the streams of air or gas from the nozzles to a hollow assemblage 200 wherein the fibers are arranged generally in spiral formation in successive loops or coils 202.

The coiled fiber assemblage 200 may be collected upon the upper flight of a conventional moving endless conveyor 204, the conveyor being mounted on rolls in the conventional manner, one of the rolls 205 being shown. As shown in FIG. 7, the assemblage 200 of coil fibers is received upon the conveyor 204 without appreciably disturbing the coiled orientation of the fibers. Disposed rearwardly of the assemblage 200 of fibers supported on the conveyor are two or more nozzles 207 each connected by a tube 209 with a source of compressed air or other gas and with a supply of fine discrete binder fibers.

The discrete binder fibers from the supply are entrained in the steams of air moving through the tubes 209 and the binder fibers 212 projected from the nozzles 207 into intermingling relation with the coiled fibers 202 of the assemblage 200, the discrete fibers wrapping around the fibers of the coils forming a bonded coiled fibrous product 214.

As shown in FIG. 7, the assemblage 200 of fibers moves in a vertical direction downwardly from the fiber-forming instrumentality and as the assemblage is received on a horizontal conveyor belt 204, the path of the fibers is changed from a vertical direction to a horizontal direction and such change in direction tends to effect an opening up of the fibers of the coils 202 to readily receive the binder fibers 212 projected by the air streams from the nozzles 207 to thereby enhance the intermingling of the discrete binder fibers with the coiled fibers of the assemblage.

The binder fibers 212, under the influence of the air streams from the nozzles 207 and turbulence of the air set up by the air streams, are caused to be wrapped around the fibers of the coils of fibers 202 to bond the assemblage of fibers into a stable generally cylindrical coiled configuration as shown at 214 in FIG. 7*a*.

FIGS. 8 and 8*a* illustrate an assemblage of several of the fiber-bonded coiled fiber products or bodies 214 arranged in parallel interengaging relation. The fiber-bonded coiled fiber assemblages 214 may be bonded into a multicoiled unit or product through the use of additional discrete binder fibers. As shown in FIG. 8, a plurality of the coil units 214 are arranged in parallel interengaging relation and may be advanced in such relation by a conveyor belt (not shown).

Disposed adjacent the several coil units is a plurality of nozzles 215 arranged in positions to deliver fine discrete binder fibers into the interengaging regions of the fiber coils 214. The nozzles 215 are connected by tubes 217 with a source of compressed air or other gas and a supply of fine discrete binder fibers. As the coils 214 are advanced by the conveyor, the nozzles 215 project the air-entrained binder fibers 218 into intermingling engagement with the fiber coils 214.

The binder fibers, under the influence of the air from the nozzles and air turbulence set up by the streams of air from the nozzles, cause the discrete binder fibers to be wrapped around fibers of the coils 214 to bond the plurality of fiber coils 214 into a multicoiled fibrous product. The nozzles 215 may be disposed with respect to the fibers coils 214 so as to obtain a satisfactory wrapping of the binder fibers around fibers of the fiber coils.

FIG. 9 is illustrative of an arrangement for carrying out the method of the invention in forming an assemblage of fibers, such as glass fibers, into a product such as a tow in which the fibers of the assemblage are bonded together through the use of fine discrete binder fibers disposed in wrapping relation around the fibers of the assemblage to form a fiber-bonded fibrous tow or roving.

The fiber attenuating instrumentality 18″ is of the character shown in FIG. 1 wherein a stream 16″ of molten glass flows from a feeder 10″ into a hollow spinner or rotor 28″ mounted on a lower end of a hollow shaft 26″, the spinner being rotated by a motor (not shown) driving a sheave 30″ on the shaft 26″. A heated environment is provided at the periphery of the spinner 28" by products of combustion from a combustion chamber of the character illustrated at 34 in FIG. 1 and enclosed by an annular member 22".

The peripheral wall of the spinner 28" is provided with a large number of orifices or openings through which streams of molten glass are delivered by centrifugal forces into a gaseous blast such as steam or compressed air from a blower 37", the forces of the blast attenuating the centrifuged streams of glass into fibers 222 of a fiber assemblage 224. The fibers of the assemblage 224 are converged at a region 226 to a linear group by means (not shown) advancing the group downwardly away from the fiber-forming instrumentality 18".

Disposed adjacent the region of convergence 226 of the fibers 222 is a plurality of nozzles 230 circumferentially spaced around the linear group of fibers and angularly arranged with respect to the vertical axis of the converged linear group of fibers. Two of the nozzles 230 are illustrated in FIG. 9 but it is to be understood that several such nozzles may be employed if desired.

Connected with the nozzles 230 are tubes 232, the tubes being connected with a source of compressed air or other gas and a supply or supplies of fine discrete binder fibers. Disposed in each of the tubes 232 is a valve or valve means 236. The valves 236 are of conventional character and are adapted to be intermittently opened and closed by suitable conventional means.

The discrete binder fibers from the supply or supplies are entrained in the air streams moving through the tubes 232 and, when the valves 236 are opened, the air-entrained binder fibers 238 and air streams are projected from the nozzles 230 into the fibers 222 of the group 224 slightly above the region 226 of convergence of the fibers into a linear group.

Under the influence of the air streams from the nozzles and air turbulence set up by the air streams, the fine discrete binder fibers are delivered into and intermingled with the fibers 222 of the fiber assemblage 224 whereby the binder fibers 238 are wrapped around the fibers 222 to bind the fibers together into a tow 240. The valves 236 are opened and closed in sequence, and the periodic or intermittent delivery of the air streams from the nozzles sets up air turbulence to enhance the wrapping of the binder fibers around the fibers of the assemblage 224 to effectively bond the fibers into a tow 240.

FIG. 10 illustrates the use of fine discrete binder fibers for bonding fibers of strands or fiber assemblages together where the strands of fibers are drawn from supply spools. While FIG. 10 illustrates the method of fiber-bonding fibers of a strand from one supply spool, it is to be understood that the method disclosed in FIG. 10 embraces applying fine discrete binder fibers to a plurality of strands drawn from several spools and wherein the strands of fibers are processed in side-by-side relation.

As shown in FIG. 10, a supply spool 244 is one of several supply spools containing strands or assemblages 246 of glass fibers disposed adjacent guide means or guide eyes 247, one of which is shown in FIG. 10. Disposed adjacent the supply spools of strands is a first guide means or member 249 of curved configuration and a second guide means or member 252 of curved configuration. The guide member 249 is fashioned with a convex surface 254 and guide member 252 fashioned with a convex surface 255, these surfaces guiding the strands or fiber assemblages during processing.

The adjacent ends of the guide members 249 and 252 are spaced providing a transition region 256 of change of direction of the strands at which region the fine discrete binder fibers are delivered for bonding fibers of the strands together. Disposed adjacent the left end of the curved guide means 249 is a row of nozzles 258 in side-by-side relation, one of which is shown in FIG. 10. Disposed adjacent the left end of the guide member 252 is a second row of nozzles 260 in side-by-side relation, one of which is shown in FIG. 10. The nozzles 258 and 260 are connected by tubes 262 and 264 with a source of compressed air or other gas under pressure.

The nozzles 258 and 260 deliver air streams at velocities sufficient to advance the strands or fiber assemblages 246. The air streams from the nozzles 258 advance the strands or fiber assemblages 246 from the spools along the convex surface 254 of the guide member 249, and the air streams from the nozzles 260 convey the strands or fiber assemblages along the convex surface 255 of the member 252 and, as the air streams from the nozzles 260 direct air into the transistion region 256, these air streams are effective to open up the fibers of the strands or fiber assemblages to receive fine discrete binder fibers.

Disposed above the transition region 256 is a plurality of nozzles 266, one of which is shown in FIG. 10, the nozzles 266 being connected by tubes 267 with a supply (not shown) of fine discrete binder fibers 270. The binder fibers 270 may be delivered or conveyed into the opened strands at the transition region 256 by air streams moving through the nozzles 266.

The binder fibers delivered from the nozzles 266 are influenced by the air streams projected from the nozzles 260 and by the air turbulence created by the air streams to effectively wrap the discrete binder fibers 270 around the fibers of the strands or fiber assemblages 246 to bond the fibers of the strands or assemblages into a fiber-bonded product 272 which may be a nonwoven textile or the like. The fiber-bonded product 272 may be collected on a spool (not shown) or collected by other suitable methods.

FIG. 11 illustrates the use of fine discrete binder fibers for bonding fibers of strands or fiber assemblages together where the strands of fibers are drawn from supply spools, the rate of advancement of certain strands of fibers being retarded or decreased to enhance the opening up of other strands of fibers to promote the wrapping of discrete binder fibers around the fibers of the strands.

While FIG. 11 illustrates the method as utilizing two spools of strands of fibers, the rate of advancement of the strand from one spool being retarded, it is to be understood that the method embraces applying fine discrete fibers to a plurality of strands drawn from spools wherein the strands of fibers are processed in side-by-side relation.

The method illustrated in FIG. 11 embraces a step of retarding the advancement of one group of strands of fibers or fiber assemblages to effect opening up of the fibers of certain of the strands or fiber assemblages to receive discrete binder fibers at the opened-up regions of the fibers and enhance the wrapping of the binder fibers about the fibers of the strands or fiber assemblages. With reference to FIG. 11, spools 276 of strands or fiber assemblages 277 of glass fibers are arranged in side-by-side relation, one of the supply spools 276 being shown in FIG. 11.

Also arranged in side-by-side relation is a second group of spools 280 containing strands or fiber assemblages 281 of glass fibers. Guide eyes 283, one of which is shown in FIG. 11, are provided for the several strands 277, and guide eyes 285 provided for the several strands 281. Disposed adjacent and above the strand supply spools is a first guide means or member 287 of curved configuration and a second guide means or member 289 of curved configuration.

The member 287 is fashioned with a convex upper surface 291 and the member 289 fashioned with a convex upper surface 293, the convex surfaces guiding the strands or fiber assemblages during processing. The adjacent ends of guide members 287 and 289 are spaced providing a transition region 295 at which region fine discrete binder fibers are delivered for bonding the fibers of the strands or fiber assemblages together. Disposed adjacent the left end of the guide member 287 is a row of nozzles 297 in side-by-side relation, one of which is shown in FIG. 11.

Disposed adjacent the left end of the guide member 289 is a second row of nozzles 300 in side-by-side relation, one of which is shown in FIG. 11. The nozzles 297 and 300 are connected by tubes 301 and 302 with a source of compressed air or other gas under pressure. The nozzles 297 and 300 deliver air or gas streams at velocities sufficient to advance the strands of fiber assemblages 277 and 281 along the convex surfaces 291 and 293 of the guide members 287 and 289.

Positioned adjacent and above the region of transition 295 or change of direction of the strands is a row of nozzles 304, one of which is shown in FIG. 11, connected by tubes 305 with a supply (not shown) of fine discrete binder fibers 306. The binder fibers may be delivered from the nozzles 304 under the influence of air streams from the nozzles into intermingling engagement with the fibers of the strands or fiber assemblages at the region of transition 295.

In order to promote opening of certain of the strands of fibers at the region of transition 295 to enhance the wrapping of discrete fibers about the fibers of the strands, the method includes retarding the advancement of one group of strands, such as the strands 281, to promote a looseness at the region of transition 295 of the fibers of the other strands 277. An arrangement 307 for retarding the speed of the strands 281 may be positioned above the guide eyes 285 and is inclusive of cylindrical guide members or rods 308 and 310 supported by suitable means (not shown).

The cylindrical guide members or rods are arranged in the relation illustrated in FIG. 11 and the strands 281 threaded first over the cylindrical member 308 thence downwardly beneath and around the second cylindrical member 310, the strands traversing a generally Z-shaped path. The frictional resistance between the strands 281 and the cylindrical members or rods 308 and 310 is effective to retard the advancement of the strands 281 from the spools 280. Retarding the speed of advancement of the strands 281 promotes a looseness or opening up of the fibers of the strands 277 at the transition region 295 and the opened fibers of the strands 277 promote wrapping of the fine discrete binder fibers around the fibers of the strands at the region 295.

Air streams delivering the binder fibers 306 from the nozzles 304 and the air streams from the nozzles 300 and the air turbulence set up by the air streams promote the wrapping of the binder fibers about the opened fibers of the strands to form a fiber-bonded product 312 which product moves around the convex surface 293 of guide member 289. The fiber-bonded fibrous product 312 is in the form of a nonwoven textile and may be collected on a collector spool (not shown) or collected by other suitable method.

While fine discrete binder fibers of glass are preferred as the binding media for holding fibers of a fiber assemblage together, the binder fibers may be of organic materials or resins such as polyvinyl resins, polyester or binder fibers of other suitable resinous fibers may be used. The binder fibers must be discrete and very fine and have a high degree of flexibility in order to foster the surrounding, encircling or wrapping of the binder fibers around the fibers of an assemblage.

It is apparent that, within the scope of the invention, modifications and different arrangements may be made other than as herein disclosed, and the present disclosure is illustrative merely, the invention comprehending all variations thereof.

I claim:

1. The method of forming a fiber-bonded assemblage of nonwoven glass fibers including advancing a loose assemblage of nonwoven glass fibers, delivering fine discrete binder fibers of glass angularly into the assemblage of nonwoven glass fibers, engaging an air stream with the fine discrete fibers, and wrapping the fine discrete fibers by the forces of the air stream about the fibers of the assemblage bonding the fibers of the assemblage together.

2. The method of forming a fiber-bonded assemblage of nonwoven glass fibers including advancing a loose assemblage of glass fibers, entraining fine discrete binder fibers of glass in an air stream, conveying the discrete fibers by the air stream angularly into the assemblage of nonwoven glass fibers, and intermingling the fine discrete glass fibers by the air stream with the nonwoven glass fibers of the assemblage wherein the discrete fibers are wrapped around the nonwoven glass fibers by the forces of the air stream bonding the glass fibers of the assemblage together.

3. The method of forming a fiber-bonded fibrous product comprising attenuating glass streams by a fiber-forming instrumentality into glass fibers, delivering fine discrete binder fibers of glass angularly into engagement with the attenuated glass fibers moving away from the fiber-forming instrumentality, engaging the fine discrete glass fibers by moving air streams, and wrapping the fine discrete fibers by the forces of the air streams about the fibers attenuated by the instrumentality for bonding the attenuated fibers into an integrated fibrous product.

4. The method of forming fiber-bonded fibrous product comprising attenuating glass streams by fiber-forming instrumentality into glass fibers forming a loose assemblage of glass fibers, delivering fine discrete binder fibers of glass entrained in air streams angularly into engagement with the fibers of the assemblage moving away from the fiber-forming instrumentality, and wrapping the fine discrete fibers by the forces of the air streams about the glass fibers of the assemblage for bonding the fibers of the assemblage into a fibrous product.

5. The method of forming a fiber-bonded fibrous product comprising attenuating glass streams into glass fibers by a fiber-forming instrumentality wherein the attenuated fibers move downwardly from the instrumentality as a hollow veil of loose fibers, entraining fine discrete binder fibers of glass in air streams, and projecting the entrained discrete fibers by the air streams angularly into the veil of attenuated fibers whereby the fine discrete binder fibers are wrapped around the fibers of the veil by the forces of the air streams to form a fiber-bonded product.

6. The method of forming a nonwoven fiber-bonded fibrous product comprising flowing a stream of molten glass into a spinner having an orificed peripheral wall, rotating the spinner to centrifuge fine streams of glass through the orifices in the spinner wall, attenuating the centrifuged streams into glass fibers wherein the glass fibers move downwardly from the spinner as a hollow veil of loose fibers, entraining fine discrete binder fibers of glass in air streams, and projecting the fine discrete binder fibers by the air streams angularly into the fibers of the veil whereby to wrap the fine discrete binder fibers by the forces of the air streams about the glass fibers of the veil for bonding the glass fibers into a bonded fibrous product.

7. The method according to claim 6 including severing one side of the veil of fibers bonded together by the fine discrete fibers, and collecting the severed fiber-bonded veil as a sheet-like nonwoven textile.

8. The method according to claim 6 including twisting the veil of attenuated glass fibers bonded by the fine discrete binder fibers into a tow.

9. The method of forming a fiber-bonded assemblage of nonwoven glass fibers including advancing a loose assemblage of nonwoven glass fibers oriented in coiled configuration, directing air streams into engagement with the assemblage, and delivering fine discrete binder fibers of glass angularly into the assemblage of nonwoven glass fibers by the air streams whereby the forces of the air streams wrap the fine discrete fibers around the fibers of the coiled assemblage bonding the fibers of the coiled assemblage together.

10. The method according to claim 9 including advancing a plurality of the glass fiber-bonded coiled loose assemblages of glass fibers in parallel interengaging relation, delivering additional fine discrete binder fibers angularly into the coiled fiber assemblages, and directing additional air streams into the coiled fiber assemblages whereby the forces of the additional air streams wrap the additional fine discrete binder fibers around the fibers of the coiled fiber assemblages bonding the coiled fiber assemblages together.

11. The method of forming a fiber-bonded assemblage of nonwoven glass fibers including advancing a loose assemblage of nonwoven glass fibers in sheet-like formation, delivering fine discrete binder fibers of glass angularly into the assemblage of glass fibers at one major surface of the assemblage, and directing air streams into the assemblage of glass fibers at said one major surface of the assemblage whereby the forces of the air streams wrap the fine discrete binder fibers about the glass fibers of the assemblage bonding the assemblage of fibers into a nonwoven bonded product.

12. The method according to claim 11 including delivering additional fine discrete binder fibers of glass angularly into the assemblage of glass fibers at the other major surface of the assemblage, and directing additional air streams into the assemblage of glass fibers at said other major surface whereby the forces of the additional air streams wrap the fine discrete fibers about the glass fibers of the assemblage.

13. The method of forming a fiber-bonded fibrous product comprising attenuating glass streams into fibers, engaging the assemblage of attenuated glass fibers with a guide surface, delivering fine discrete binder fibers of glass angularly into the assemblage of attenuated glass fibers at the region of the guide surface, projecting air streams along the guide surface into engagement with the assemblage of fibers and the fine discrete binder fibers, and wrapping the discrete binder fibers about the glass fibers of the assemblage by forces of the air streams whereby the fine discrete binder fibers bond the glass fibers of the assemblage into a fibrous product.

14. The method of forming a fiber-bonded fibrous product comprising attenuating glass streams into continuous glass fibers forming an assembly of fibers, engaging the assemblage of attenuated continuous glass fibers with a guide surface, delivering fine discrete binder fibers of glass angularly into the assemblage of attenuated continuous glass fibers at the region of the guide surface, projecting air streams along the guide surface into engagement with the assemblage of continuous glass fibers and the fine discrete binder fibers, and wrapping the discrete binder fibers about the continuous glass fibers of the assemblage by the forces of the air streams whereby the fine discrete binder fibers bond the continuous glass fibers into a fibrous product.

15. The method of forming a fiber-bonded fibrous product comprising advancing a loose assemblage of glass fibers, engaging the assemblage of glass fibers with a curved guide surface, delivering fine discrete binder fibers of glass angularly into the advancing assemblage of glass fibers at the region of said surface, projecting air streams along the curved guide surface into engagement with the assemblage of fibers and the fine discrete binder fibers, and wrapping the discrete binder fibers about the fibers of the assemblage by the forces of the air streams whereby the fine discrete binder fibers bond the glass fibers of the assembly into a fibrous product.

16. The method of forming a fiber-bonded fibrous product comprising advancing an assemblage of nonwoven glass fibers along a first guide surface, changing the direction of movement of the assemblage of glass fibers by a second guide surface, delivering fine discrete binder fibers of glass angularly into the assemblage of glass fibers at the region of change of direction of movement of the assemblage of glass fibers, directing air streams along the second guide surface for advancing the assemblage of glass fibers and fine discrete binder fibers along the second guide surface, and wrapping the discrete binder fibers about the fibers of the assemblage at the region of change of direction of movement of the assemblage of glass fibers by the forces of the air streams to form a bonded fibrous product.

17. The method of forming a fiber-bonded fibrous product comprising attenuating glass streams into fibers, moving a loose assemblage of the attenuated glass fibers along a first guide surface, changing the direction of movement of the assemblage of glass fibers by a second guide surface, delivering fine discrete binder fibers of glass angularly into the assemblage of glass fibers at the region of change of direction of movement of the assemblage, directing air streams along the second guide surface for advancing the assemblage of glass fibers and fine discrete binder fibers along the second guide surface, and wrapping the discrete binder fibers about the fibers of the assemblage at the region of change of direction of movement of the assemblage of glass fibers by the forces of the air streams to form a bonded fibrous product.

18. The method of forming a fiber-bonded fibrous product including advancing assemblages of nonwoven glass fibers by first air streams along a first guide surface, advancing the assemblages of glass fibers by second air streams along a second guide surface spaced from said first guide surface, changing the direction of movement of the assemblages of glass fibers at the region of the space between the guide surfaces, delivering fine discrete binder fibers of glass angularly into the fibers of the assemblages at the region of change of direction of movement of the assemblages, and wrapping the fine discrete binder fibers around the glass fibers of the assemblages at the region of the change of direction of movement of the fibers of the assemblages by the forces of the second air streams whereby the fine discrete binder fibers bond the glass fibers of the assemblages into a fibrous product.

19. The method of forming a nonwoven fiber-bonded fibrous product including advancing strands of glass fibers by first air streams along a first curved guide surface, advancing the strands by second air streams along a second curved guide surface spaced from the first guide surface, changing the direction of movement of the strands at the region of the space between the guide surfaces, projecting fine discrete binder fibers of glass angularly into the fibers of the strands at the region of change of direction of movement of the strands, and wrapping the fine discrete binder fibers around the fibers of the strands by the forces of the second air streams whereby the fine discrete binder fibers bond the glass fibers of the strands into a fibrous product.

20. The method of forming a nonwoven fiber-bonded fibrous product including advancing two groups of assemblages of nonwoven glass fibers by first air streams along a first guide surface, advancing the groups of assemblages of glass fibers by second air streams along a second guide surface spaced from the first guide surface, changing the direction of movement of the groups of assemblages of glass fibers at the region of the space between the guide surfaces, retarding the speed of advancement of at least one assemblage of glass fibers to open up the fibers of the unretarded assemblages at the region of the space between the guide surfaces, projecting fine discrete binder fibers of glass angularly into the fibers of the assemblages at the region of change of direction of movement of the assemblages, and wrapping the fine discrete binder fibers around the fibers of the assemblages at said region by the forces of the second air streams whereby the fine discrete fibers bond the glass fibers of the assemblages into a fibrous product.

21. The method of forming a nonwoven fiber-bonded fibrous product comprising advancing a nonwoven assemblage of glass fibers, converging the assemblage of glass fibers into a linear body, entraining fine discrete binder fibers of glass in air streams, projecting the air streams and fine discrete binder fibers entrained therein angularly into the body of glass fibers adjacent the region of convergence of the assemblage of glass fibers into a linear body, successively interrupting the air streams, and wrapping the fine discrete binder fibers around the glass fibers of the assemblage by the forces of the intermittent air streams whereby the fine discrete fibers bond the linear body of glass fibers into a tow.

22. A fibrous product comprising a body of nonwoven glass fibers, and fine discrete binder fibers of glass wrapped around the nonwoven fibers bonding the nonwoven fibers together.

23. A fibrous product comprising an assemblage of nonwoven glass fibers, and highly flexible fine discrete binder fibers of glass wrapped around the fibers of the assemblage bonding the fibers of the assemblage together.

24. A fibrous product comprising an assemblage of nonwoven glass fibers, and highly flexible discrete binder fibers of glass wrapped around the fibers of the assemblage bonding the fibers of the assemblage together, the average diameter of the fibers of the assemblage being greater than the average diameter of the discrete binder fibers.

25. A fibrous product comprising an assemblage of comparatively coarse nonwoven glass fibers, and fine discrete binder fibers of glass wrapped around the coarser fibers bonding the coarser fibers together.

26. Apparatus for forming a fiber-bonded nonwoven glass fiber product wherein the glass fibers of the product are bonded together by fine discrete binder fibers comprising, in combination, a fiber-forming instrumentality for attenuating glass streams into glass fibers providing a body of fibers, a plurality of nozzles disposed adjacent the body of attenuated glass fibers, said nozzles being in communication with a source of compressed air and a supply of fine discrete binder fibers of glass, said nozzles arranged to deliver air streams with the fine discrete binder fibers entrained therein angularly into the body of attenuated glass fibers whereby the discrete binder fibers are wrapped around the attenuated glass fibers of the body by the forces of the air streams to form a nonwoven fiber-bonded fibrous product.

27. The apparatus according to claim 26 including valve means associated with said nozzles for intermittently and successively interrupting the air streams.

28. Apparatus for forming a nonwoven fiber-bonded glass fibrous product wherein the glass fibers of the product are bonded together by fine discrete binder fibers of glass comprising, in combination, means for attenuating glass streams into glass fibers providing a moving assemblage of glass fibers, a curved guide surface engaged by the moving assemblage of attenuated glass fibers, a plurality of first nozzles for directing streams of air along the curved surface into the fibers of the assemblage, and a plurality of second nozzles disposed adjacent the curved surface arranged to deliver fine discrete binder fibers of glass angularly into the fibers of the assemblage, the forces of the air streams wrapping the fine discrete binder fibers around the fibers of the assemblage to form a nonwoven bonded fibrous product.

29. Apparatus for forming a nonwoven fiber-bonded glass fiber product wherein the glass fibers of the product are bonded together by fine discrete binder fibers of glass comprising, in combination, spaced first and second curved guide members, a first group of nozzles arranged adjacent the first guide member, the nozzles of the first group being adapted to project air streams along the first guide surface and into engagement with a first group of strands of glass fibers for advancing the strands along the first guide surface, a second group of nozzles disposed adjacent the second guide surface, said nozzles of the second group arranged to deliver air streams for advancing the group of strands along the second guide surface, and a third group of nozzles arranged adjacent the space between the guide surfaces and in communication with a supply of fine discrete binder fibers of glass, the nozzles of the third group delivering the fine discrete binder fibers angularly into the fibers of the strands of the groups at the space between the guide surfaces whereby the forces of the air streams from the second group of nozzles wrap the fine discrete binder fibers around the glass fibers of the groups forming a bonded fibrous product.

30. The apparatus according to claim 29 including means for retarding advancement of at least one of the strands of glass fibers to promote opening up of the glass fibers at the region of delivery of the fine discrete binder fibers into the fibers of the strands to enhance wrapping of the discrete fibers around the fibers of the strands.

* * * * *